US005184446A

United States Patent [19]

Gustavsen

[11] Patent Number: 5,184,446

[45] Date of Patent: Feb. 9, 1993

[54] ROLLER PLATFORM FOR INSTALLING PLANAR FLOORING

[76] Inventor: Willard Gustavsen, 12142 Rangeline, Berrien Springs, Mich. 49103

[21] Appl. No.: 753,398

[22] Filed: Aug. 30, 1991

[51] Int. Cl.[5] ..... E04B 1/00

[52] U.S. Cl. ..... 52/746; 52/749; 280/79.11

[58] Field of Search ..... 52/476, 477, 479; 280/79.11

[56] References Cited

U.S. PATENT DOCUMENTS

| | | | |
|---|---|---|---|
| 3,558,152 | 1/1971 | Miles et al. | 280/79.11 X |
| 4,178,006 | 12/1979 | Johnson | 280/79.11 |
| 4,479,739 | 10/1984 | Schweikert | 52/749 X |
| 4,725,328 | 2/1988 | Arnold | 52/746 X |
| 4,824,129 | 4/1989 | Rehrig | 280/79.11 |
| 4,869,044 | 9/1989 | Wald | 52/746 |
| 4,967,535 | 11/1990 | Alderman | 52/749 |

FOREIGN PATENT DOCUMENTS

| | | | |
|---|---|---|---|
| 1198519 | 8/1965 | Fed. Rep. of Germany | 52/749 |
| 531912 | 10/1976 | U.S.S.R. | 52/749 |

*Primary Examiner*—Richard E. Chilcot, Jr.

*Assistant Examiner*—Lan Mai

*Attorney, Agent, or Firm*—Dykema Gossett

[57] ABSTRACT

A unique platform performs several functions in the installation of planar flooring. The platform has a planar top face and a pair of wheel sets on an underface. In a first function the platforms are used in groups of two, and positioned with the wheels extending upwardly and spaced from each other such that the axis of rotations of the sets of wheels on the two platforms are generally parallel and aligned. A coil of planar flooring material is placed on the spaced platforms, such that the planar flooring material may be removed from the coil with the wheels turning to aid in the removal and protect the surface of the flooring. After the planar material is removed and has been adhesively applied to a floor, the platforms perform a second function. They are reversed and a force is applied to the platform such that the wheels roll along the planar flooring and cause the adhesive to wet and firmly secure the planar flooring to the underlying floor. The spaced platform may be used in a third function where they are spaced along an axis and positioned such that their wheel axes are perpendicular to the spacing axis. The coil may be placed on the platforms and transported.

5 Claims, 3 Drawing Sheets

ROLLER PLATFORM FOR INSTALLING PLANAR FLOORING

BACKGROUND OF THE INVENTION

This application in general relates to a platform which performs several functions in the installation of planar flooring.

An installer of planar flooring, such as Linoleum TM, typically requires a device for applying a force to the flooring once it is attached by adhesive to an underlying floor. A force needs to be applied to the flooring to "wet" the adhesive and ensure that it is fully connects the flooring to the underlying floor. Planar flooring manufacturers require a minimum applied force to wet the adhesive in order to meet their warranty requirements.

In the prior art, heavy rollers which weighed on the order of a 100 pounds are typically utilized. A handle extends from the weighted rollers and allows an installer to easily maneuver the rollers. The weight of the rollers provided the required force. The relatively great weight of this device is undesirable.

The installer also typically needs a cradle to support a coil of planar flooring as the flooring is unrolled, and cut for installation. The prior art typically used a large device to perform this function.

The installer also typically needs a device to transport the coil of planar flooring to a job site. The transport devices have typically been large.

It is a goal in this art to reduce the number of tools which are necessary, and further to reduce the size and weight of any individual tools. Thus, the prior art requirement of three separate tools, each of which were relatively large, to perform the function of wetting the adhesive, supporting the coil while it is uncoiled, and transporting the coil, is undesirable.

SUMMARY OF THE INVENTION

In a disclosed embodiment of the present invention, a roller platform has a planar platform with a top face. Sets of wheels are secured to axially front and rear locations of the platform. Preferably, there are three wheels at both front and rear locations. The front and rear wheel sets rotate about spaced parallel axes. Two wheel mounts extend downwardly from an underface of the platform for each wheel set. A central wheel is disposed between the laterally spaced wheel mounts at both the front and rear position. Outer wheels are supported laterally outwardly of respective wheel mounts.

In a preferred embodiment, the outer wheels extend laterally outwardly beyond the laterally outermost extent of the platform. This provides a relatively large area of coverage for wetting the adhesive, and also for supporting the coils. Further, the outer wheels preferably have counterbores at their laterally outer ends, with an axle bolt head received in one counterbore, and a nut received in the opposed counterbore. The nut and bolt head do not extend laterally to the laterally outermost extent of the outer wheels. Thus, when the platform is rolled along an edge of a wall, the bolt head and nut do not engage the wall, but rather the roller can be utilized at locations which abut the wall.

In a most preferred embodiment, the front and rear wheel axles are spaced by a distance such that there is adequate room to support coils of average diameter planar flooring materials. Typically, the coils have a four inch core. Most preferably, a most rearward portion of the front wheel is spaced from a most forward portion of the rear wheel by approximately 4 to 6 inches. More preferably, the wheels are two inches in diameter.

In a method according to the present invention, the platforms are used in pairs. The platforms may initially be utilized to transport a coil of planar flooring material to a work area. The coil is then preferably removed from the platforms. The platforms are placed with their top face on the ground and their wheels extending vertically upwardly. The two platforms are preferably positioned such that their wheel axes are generally parallel and aligned to each other. The coil is then placed on the two platforms.

An installer removes sufficient planar flooring material from the coil to cover a floor and cuts the material. The wheels roll to facilitate removal of material from the coil, and protect the finish of the flooring. Adhesive is then applied to the floor and the cut flooring is then placed on an underlying floor.

The coil is then removed from the platforms, which are turned over such that the wheels now rest on the ground. The platform is placed on the installed planar flooring, and an installer places weight on the platform to ensure that the flooring adequately contacts the adhesive. Preferably, the installer applies a force from a foot against the platform. The installer's foot controls the platform such that the wheels cover the surface area of the planar flooring. In this way, the weight of the installer, rather than the weight of the tool, provides the required force to apply the flooring to the adhesive. The installer thus does not have to carry a heavy roller to the job site.

Once the planar flooring is adequately secured, the platforms may be turned such that the axes of rotation of the respective platforms are parallel and spaced from each other along an axis perpendicular to the axes of rotations of the wheels. The coil may then be placed on the platforms and transported from the work site.

These and other features of the present invention can be best understood from the following specification and drawings, of which the following is a brief description.

DETAILED DESCRIPTION OF A PREFERRED EMBODIMENT

Figure 1:
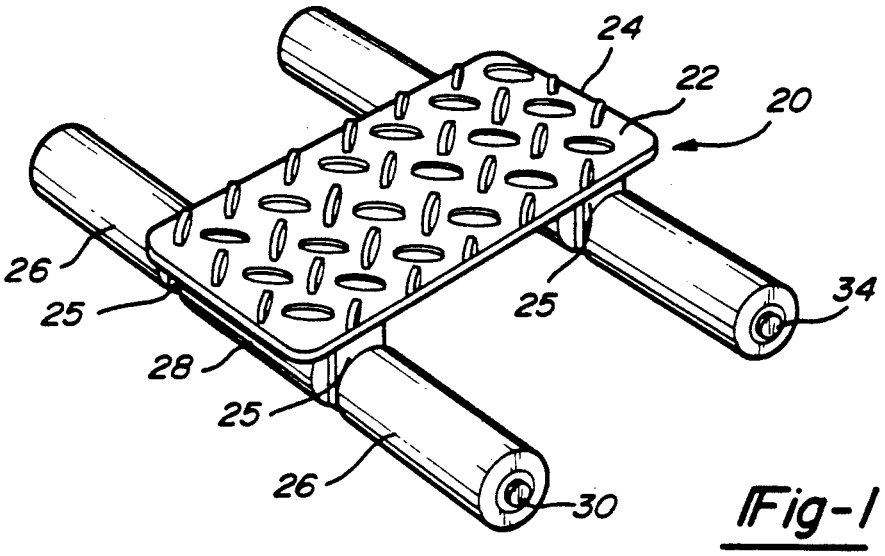
FIG. 1 is a perspective view of a platform according to the present invention.

A roller platform 20 includes a planar platform 22 having a top face 24, and a plurality of wheel supports 25 extending downwardly from an underface. Diamond-shaped bumps are formed on top of face 28 to prevent slipping. An axially forward wheel set, including a central wheel 27 and two laterally outer wheels 26 rotates about a forward axle 30. Axle 30 is formed of a bolt having a bolt head received in a counter bore 32 in one axially outer wheel 26. A rear wheel set has laterally outer wheels 26 and central wheel 28 and rotates about a rear axle 34.

Figure 2:
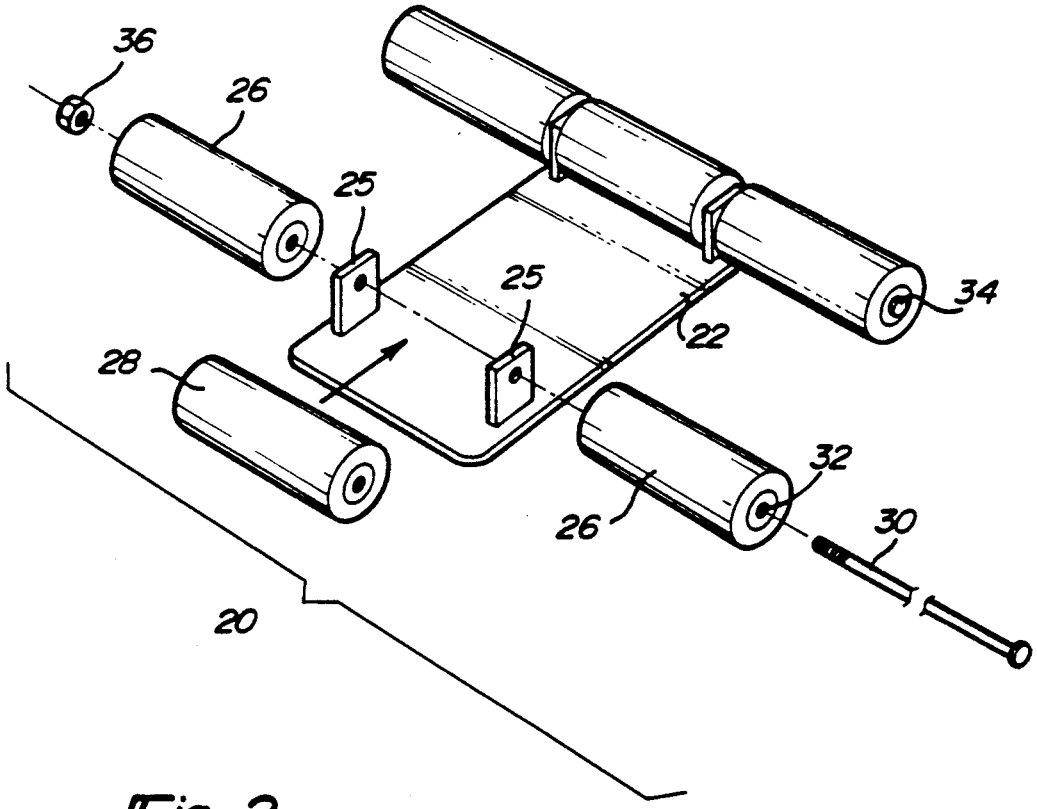
FIG. 2 is a partial assembly view of the platform illustrated in FIG. 1.

The construction of roller platform 20 can be best understood from FIG. 2. Axle 30 consists of a bolt having a bolt head received within counterbore 32 in outer wheel 26, and a threaded end which is received within a nut 36 in a counterbore in the opposed outer wheel 26. Axle 30 extends through one outer wheel 26, an aperture in a wheel mount 25, through central wheel 28, through the opposed wheel mount 25, and through the opposed outer wheel 26. Axle 34 is constructed similarly. The bolt head and nut 36 on axle 30 are both fully received within counterbores 32. The laterally outermost portions of wheels 26 are thus wheel end surfaces, rather than a bolt head or nut.

Roller platform 20 provides an installer of planar flooring with a single tool that can perform three functions. The single tool replaces three tools used in the prior art, and is also smaller and lighter than any one of the three prior art tools.

Figure 3:
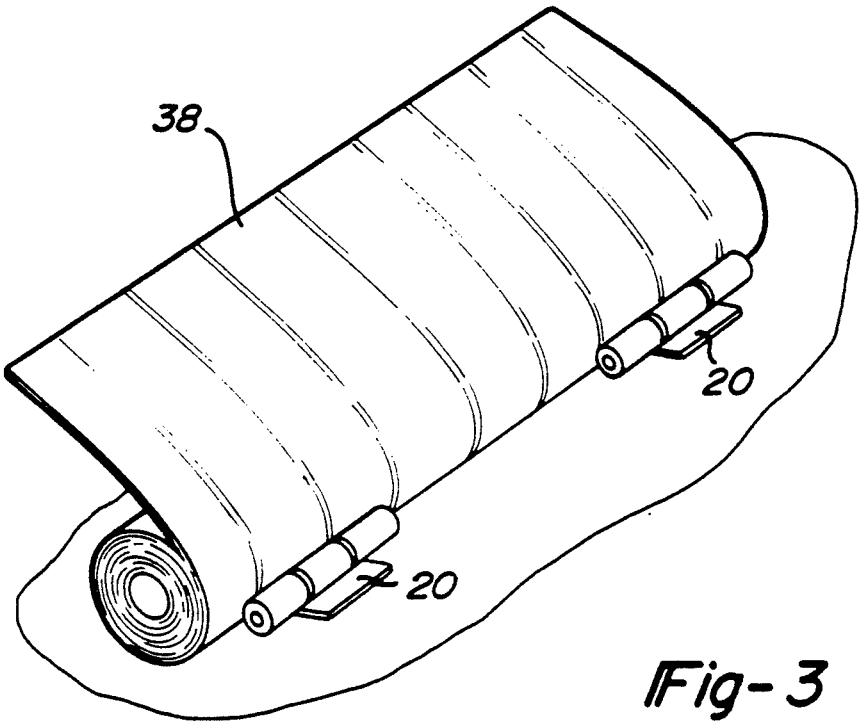
FIG. 3 is a view of the platform of the present invention performing a first function.

As shown in FIG. 3, a pair of roller platforms 20 may be spaced such that their front and rear axle are aligned. A coil of planar flooring material 38 is then placed on roller platforms 20. As the material on coil 38 is removed, the wheels on the roller platforms 20 spin to support the removed material. If coil 38 were supported on the ground when the material were removed, the floor surface that supports coil 38 may damage the outer surface of the planar flooring material.

Figure 4:
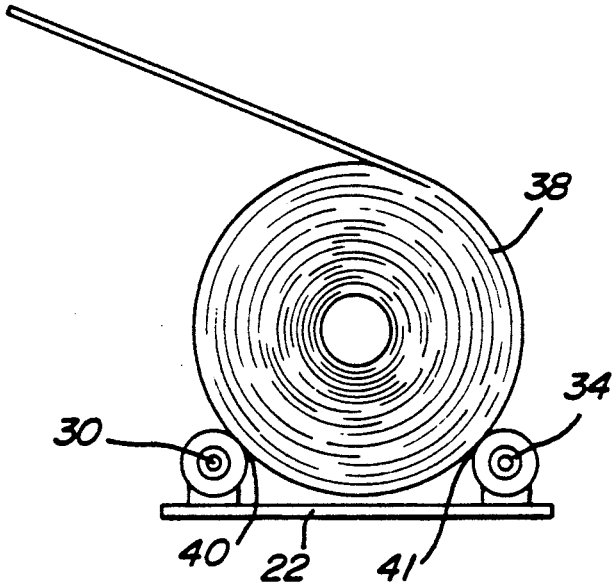
FIG. 4 is a side view of the function illustrated in FIG. 3.

As shown in FIG. 4, coil 38 is supported between the front wheel set on axle 30, and the rear wheel set on axle 34. A rearwardmost point 40 on front wheel set 30 is spaced from a forwardmost point 41 on rear wheel set 34 by a distance such that standard dimension coils 38 will be adequately supported. If the points 40 and 41 are spaced by an overly great amount, coil 38 could fall between wheel sets 30 and 34 and contact the underside of platform 22. Alternatively, if wheel sets 30 and 34 were too close, they may not adequately support coil 38. The preferred distance between points 40 and 41 is between 4 to 6 inches. Most preferably, the distance would be 4 and ¾ inches. Further, wheels 25 and 26 are preferably 2 inches in diameter.

Figure 5:
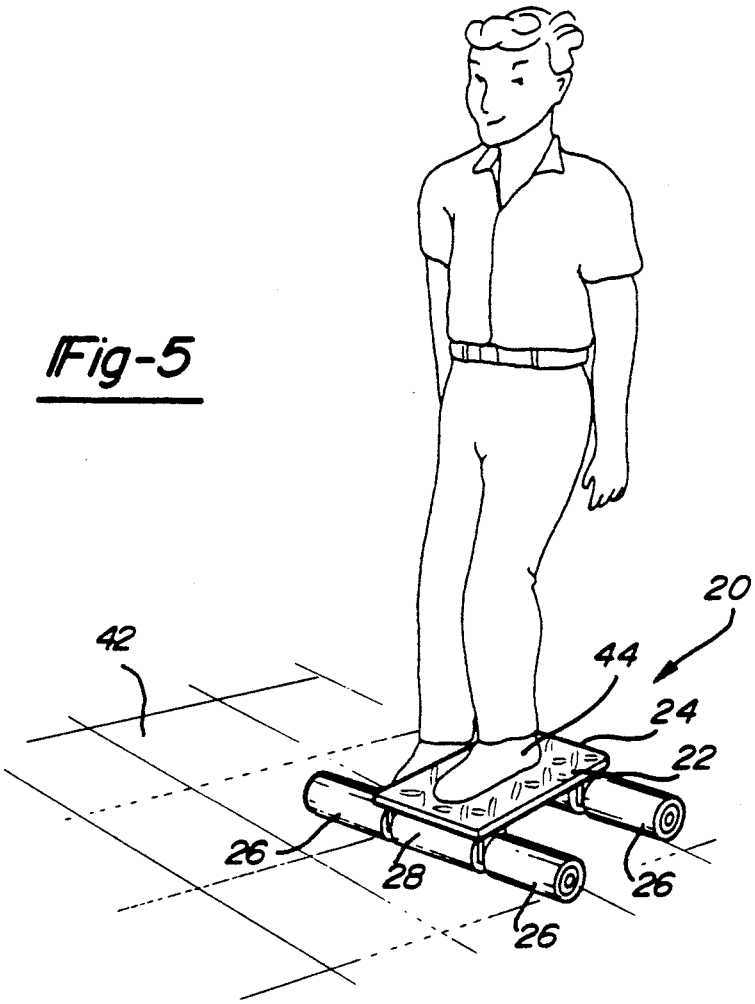
FIG. 5 is a perspective view showing the platform being utilized to perform a second function.

A second function of roller platforms 20 is illustrated in FIG. 5. A portion of a planar flooring material 42 has now been placed on an underlying floor. An adhesive has been coated on the floor and the planar flooring 42 has been placed on the underlying floor. An operator now places a foot 44 on top face 24 of platform 22, and applies weight as he rolls wheels 26 and 28 over flooring 42. This allows the installer to use his body weight to wet the adhesive.

Further, since the bolt heads and nut are received within counterbores 32 in the laterally outer wheels 26, the wheels may roll at locations adjacent walls, without having interference between the nuts or bolt heads and the walls. Moreover, since the wheels extend laterally outwardly of the surface of platform 22 a relatively wide area of coverage is provided. Furthermore, the two wheel sets rolling over the floor, provide a double force ensuring adequate wetting of the adhesive between flooring 42 and underlying flooring surface.

Figure 6:
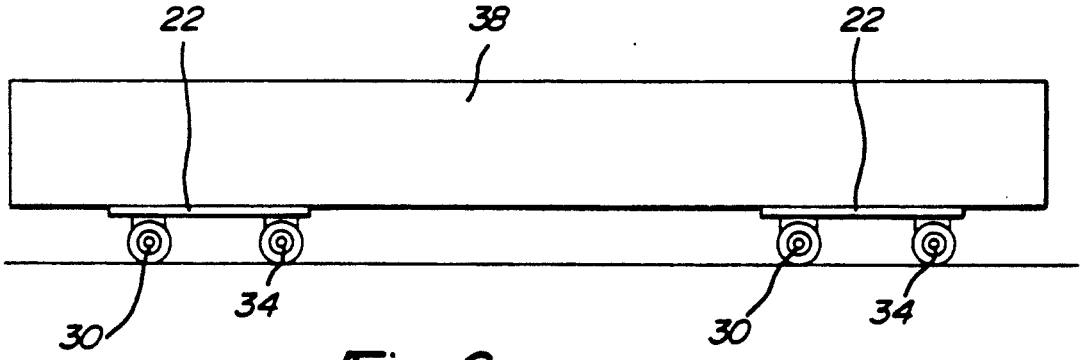
FIG. 6 is a view showing the platform perfoming a third function.

FIG. 6 shows another function of the inventive roller platform 20. A pair of roller platforms 20 are spaced along a distance which is perpendicular to the axes of their wheel sets 30 and 34. Coil 38 is supported on platforms 22, and an installer may now transport coil 38 to or from a work area.

In both the second and third functions shown in FIGS. 3 and 6, the distance between the platforms can be adjusted to adjust the distance between the support points for the coils.

In a preferred embodiment of the present invention, the wheels are formed of a material available under the tradename Delrym.

Although a preferred embodiment has been disclosed, a worker or ordinary skill in the art would recognize that certain modifications would come within the scope of this invention. Thus, the following claims should be studied in order to determine the true scope and content of the invention.

I claim:

1. A method of installing a planar flooring comprising the steps of:

1) forming a wheeled platform having a first wheel set rotatable about a forward axis and a second wheel set rotatable about a rear axis spaced from the forward axis, and placing the wheeled platform on a top face such that the wheel sets extend upwardly from said platform;
2) resting a coil of planar flooring on the wheel sets, such that the flooring may be removed from the coil with the wheel sets rolling to support the coil and allow such removal; and
3) removing the coil from the wheel sets, turning the platform over such that the wheel sets now rest on the planar flooring, and the platform extends vertically above the wheel sets, applying a force to the platform and rolling it over the planar flooring.

2. The method as recited in claim 1, wherein two spaced platforms are utilized to perform step 2), with the coil resting on both spaced platforms.

3. The method as recited in claim 1, wherein the planar flooring material is cut from the coil after having been removed in step 2), an adhesive is applied to a floor surface, and the planar flooring is placed on a floor surface prior to step 3), step 3) forcing the planar flooring against the floor surface such that the adhesive firmly secures the planar flooring to the floor surface.

4. The method as recited in claim 1, wherein the force on the platform is applied from a foot of an installer.

5. The method as recited in claim 1, wherein two of the platforms are spaced from each other along a dimension perpendicular to the axis of rotation of the wheels, with the wheel sets lying on the floor and the platform spaced vertically from the wheel sets, and the coil is placed on the spaced platforms and transported.

* * * * *